US006241791B1

(12) United States Patent
Trotta et al.

(10) Patent No.: US 6,241,791 B1
(45) Date of Patent: Jun. 5, 2001

(54) LIQUID MIXTURE SUITABLE AS GASOLINE

(75) Inventors: Roberto Trotta; Mario Marchionna, both of Milan; Alberto Paggini, Spino D'Adda, all of (IT)

(73) Assignees: Snamprogetti S.p.A., S. Donato Milanese; Ecofuel S.p.A., Milan, both of (IT)

( * ) Notice: Subject to any disclaimer, the term of this patent is extended or adjusted under 35 U.S.C. 154(b) by 0 days.

(21) Appl. No.: 09/532,092

(22) Filed: Mar. 21, 2000

(30) Foreign Application Priority Data

Mar. 31, 1999 (IT) ..... MI99A0662

(51) Int. Cl.[7] ..... C10L 1/18
(52) U.S. Cl. ..... 44/451; 585/14
(58) Field of Search ..... 44/459, 451; 585/14

(56) References Cited

U.S. PATENT DOCUMENTS

| | | | | |
|---|---|---|---|---|
| 3,999,960 | * | 12/1976 | Langer | 44/459 |
| 4,014,663 | * | 3/1977 | Feldman | 44/459 |
| 4,197,185 | | 4/1980 | Le Page et al. | 208/71 |
| 4,268,700 | | 5/1981 | Vu et al. | 585/302 |
| 5,510,555 | * | 4/1996 | Brunelli | 585/508 |
| 5,593,463 | * | 1/1997 | Gambini | 44/300 |
| 5,856,604 | | 1/1999 | Stine et al. | 585/310 |
| 5,877,372 | | 3/1999 | Evans et al. | 585/510 |

FOREIGN PATENT DOCUMENTS 2 186 287 8/1987 (GB) .

OTHER PUBLICATIONS

Derwent Abstracts, Accession No. 94–260791 ç32!, JP6192667, Jul. 12, 1994.

* cited by examiner

*Primary Examiner*—Margaret Medley
*Assistant Examiner*—Cephia D. Toomer
(74) *Attorney, Agent, or Firm*—Oblon, Spivak, McClelland, Maier & Neustadt, P.C.

(57) ABSTRACT

Liquid mixture suitable as gasoline characterized in hat it has a RON octane number equal to or higher than 90 and a MON octane number equal to or higher than 80 and that it essentially consists of:

a typical gasoline cut, having a boiling point ranging from 30 to 220° C. consisting of hydrocarbon compounds;

one or more compounds deriving from the selective oligomerization of isobutene, which may optionally have been at least partially hydrogenated, in a quantity ranging from 0.5 to 20% by weight, wherein the dimers of isobutene and possible co-dimers of isobutene with n-butenes are in a quantity of at least 80% by weight;

optionally ethanol in a quantity ranging from 0 to 10% by weight, the complement to 100 being said gasoline cut.

5 Claims, No Drawings

LIQUID MIXTURE SUITABLE AS GASOLINE

The present invention relates to a liquid mixture suitable as gasoline in compliance with the strictest regulations.

The influence of the quality of fuels on the reduction of emissions definitely plays a very important role.

In both the United States and Europe, this problem has been faced with legislative proposals (for example, in the United States, the "Clean Air Act") and detailed studies (the so-called "Auto-Oil" Programs) which have underlined the main correlations between the composition of fuels, the types of engines and the emissions observed. The results of these correlation studies between composition and emissions have demonstrated that some characteristics of fuels for motor vehicles must be modified. From a legislative point of view, therefore, the relative composition specifications have been (or are about to be) changed, and refineries are consequently compelled to effect several process or product innovations which will enable them to produce fuels whose characteristics comply with the modified specifications.

With respect to gasoline, the most important aspects are generally the following:

- the content of sulfur, benzene, aromatic hydrocarbons and olefins (mainly light olefins) should be reduced;
- the volatility should also be reduced and the heavier gasoline cut should be partly removed;
- oxygenated compounds, i.e. ethers (such as MTBE, but not only MTBE) or poly-branched paraffinic compounds such as for example those contained in the alkylate (iso-octane and trimethyl pentanes in general) are, on the other hand, extremely desirable (both for their high octane number and for their positive influence on the emissions).

Aromatic compounds have always been among the main components of gasoline and among the greatest contributors to the octane number. A lowering in the content of aromatics therefore causes a reduction in the quantity of gasoline produced by the refinery and a deficiency in the octane number. In addition, as aromatic compounds have a low vapour pressure, their reduction tends to increase the volatility of the gasoline. This tendential increase in volatility, in turn, causes a reduction in the content of light hydrocarbons and in particular normal-butane, which can be added to gasoline, especially during the winter months, when the vapour pressure may increase. Under these conditions, n-butane can practically only be used as GPL.

A kind of adverse cycle is therefore created as n-butane is an octane producer and increases the volume of the gasoline produced; in addition the introduction of n-butane into gasoline has a beneficial economic effect as it allows a semi-processed product either coming directly from the distillation of crude oil, for whose production it has not been necessary to invest in process plants, or generated as by-product from other process units, to be sold at the same price as gasoline. As a result, its reduction also causes direct economic damage.

From what is specified above, it is evident that the process which will produce fuels for motor vehicles, having a gradually decreasing environmental impact, requires great technological effort, as all the problems described above must be technically solved and at the same time economically acceptable.

The main oxygenated compounds which can be used are ethanol and ter-alkyl ethers.

Ethanol which generally comes from the fermentation of wheat, barley or sugarbeet, is very expensive and consequently, apart from some specific situations, its use in gasoline can be economically sustained only when tax reductions are granted. Ethanol however has particularly interesting octane characteristics, blending (RON+MON)/2=107–113, and enables the minimum oxygen content specification to be reached (when compulsory as in reformulated gasoline in the U.S.A.), using smaller concentrations of oxygenated product with respect to ethers.

Owing to its affinity towards water however, it is not mixed together with the gasoline directly in the refinery but is only added just before the last distribution network.

Moreover ethanol easily forms low-boiling azeotropic mixtures with the components of gasoline and in fact its typical vapour pressure (Rvp) varies from 17 to 22 psi.

In addition, excessively high concentrations of ethanol (up to 3.7% of oxygen by weight, about 10% of ethanol by volume) seem to cause an increase, of 4 to 8% more, in the emissions of $NO_x$ (G. H. Unzelman, Fuel Reformation, July/August 1995, 45): increased emissions of $NO_x$ can also cause increases in the emissions of atmospheric ozone.

Among the oxygenated compounds, ter-alkyl ethers have proved to be preferable; among these the most important are MTBE (methyl-ter-butylether), ETBE (ethyl-ter-butylether), TAME (ter-amyl-methylether) and TAEE (ter-amyl-ethylether). These ethers are generally obtained by the reaction in liquid phase of $C_4$–$C_5$ iso-olefins (i.e. isobutene or some isoamylenes) with methanol (MTBE, TAME) or ethanol (ETBE, TAEE), in the presence of an ion exchange acid macromolecular resin as catalyst.

The production of these ethers, mainly MTBE, has continually increased in the last few years, so much so that MTBE has become the chemical product which has had the most rapid growth in the history of industrial chemistry.

In refineries, isobutene is normally contained in a stream generated by a Fluid Catalytic Cracking (FCC) plant, whereas in petrolchemical complexes in a stream generated by an ethylene (Steam Cracker) plant. As the quantity of isobutene contained in these charges however is not in itself sufficient to cover the 16 million tons of MTBE presently consumed every year in the world, the use of various dehydrogenation technologies of isobutane has become popular in the last 10 years. In this way it is possible to exploit the so-called field butanes, i.e. the butanes obtained by the fractionation of natural gas. Another important source for the production of MTBE is ter-butanol which is obtained together with propylene oxide by the reaction of propylene and isobutane (the latter pretreated with oxygen); the alcohol obtained is then easily dehydrated to isobutene.

Another reduction source could be the isobutanol obtained by the synthesis of methanol and higher alcohols from CO and $H_2$ (D. Sanfilippo, E. Micheli, I. Miracca, L. Tagliabue, Petr. Tech. Quat., Spring 1998, 87).

The use of MTBE and other ethers does not have only octane advantages: in fact the oxygen atom present in their molecule improves the combustion of gasolines. The resulting ecological advantage is considerable as the content of CO and uncombusted hydrocarbons emitted from the exhaust pipe is reduced.

In addition to oxygenated compounds, completely hydrocarbon products could also prove to be particularly convenient for the production of gasolines with a low environmental impact. Among these, the most important one is the alkylated product.

Alkylation is a refinery process which consists in the formation of highly branched paraffins with a high octane number, by the catalytic reaction of isobutane with light olefins such as propylene and butenes. Typical catalysts of this reaction are some mineral acids such as hydrofluoric acid and sulfuric acid.

The charge which is generally alkylated is the $C_4$ stream coming from Catalytic Cracking, as it is rich in both butenes and isobutane.

In many cases, before being "alkylated", this charge is fed to the MTBE plant where the isobutene reacts with methanol. As far as the quality of the product is concerned, the alkylated product is ideal gasoline. Its motoristic properties are excellent: the Research octane number (RON) is very high, but above all, the Motor octane number (MON) is exceptionally high. The alkylated product, moreover, does not contain aromatic compounds, sulfur and olefins, it respects the specifications for the boiling range and has a low volatility. It therefore has all the fundamental requisites for being an ideal component for reformulated, environmentally compatible gasolines.

From an environmental point of view, both $H_2SO_4$ and HF are strong acids, classified among dangerous sub-stances, owing to their corrosive liquid nature. If they are accidentally discharged into the air, however, HF, which is extremely volatile, forms a cloud of toxic vapours, whereas $H_2SO_4$ remains liquid and is therefore easier to treat. It should be pointed out, on the other hand, that the handling of enormous volumes of $H_2SO_4$ in routine operations, the disposing of its by-products and transporting the acid for its recovery, represent in any case an extremely high risk for the environment. In addition the sulfuric acid process also has the problem of the emission of sulfur oxides. Regardless of the place where the acid is recovered, the emission into the atmosphere of sulfur oxides can constitute a serious environmental problem.

To avoid environmental problems caused by sulfuric acid and hydrofluoric acid, various alternative processes are at present being developed, which use solid acid catalysts. These processes however have not yet been applied on an industrial scale (Oil & Gas Journal, Sep. 9, 1996, 56).

It can therefore be noted that, if, on the one hand, the alkylated product represents a "target" which is definitely desirable from an environmental point of view, the same cannot be said for the catalysts which are at present used for its production.

Its production is also greatly limited by the quantity of butenes available in the refinery, i.e. by the capacity of the catalytic Cracking. The charges which can be alkylated, in fact, must contain olefins and, in the refinery, these charges only derive from treatment such as Fluid Catalytic Cracking (FCC), Visbreaking, Flexicoking and Delayed Coking. Of these, the most important is obviously catalytic Cracking.

In addition, to avoid a deficiency in -isobutane (usually the quantity of isobutane generated in the refinery is less than that requested by alkylation), it is normally necessary to transform normal butane into isobutane via skeleton isomerization. To do this a specific process unit is required.

It should be noted that, whereas MTBE is now a "commodity" available everywhere world-wide, the alkylated product is a refinery product destined only for captive use. At the moment there is no market for the alkylated product in the world and its supply is not possible. The possibility of having large quantities of alkylated product would, on the other hand, be very advantageous.

Various alternatives have been proposed in the past for substituting the alkylated product with other high-octane products with similar characteristics. Among these, particular importance could be given to the dimerization reaction of isobutene with the formation of a mixture of highly branched $C_8$ hydrocarbons (diisobutene or iso-octene) which, by subsequent hydrogenation, can be easily transformed into iso-octane.

It should be remembered that iso-octane, i.e. 2,2,4-trimethyl pentane, is the branched $C_8$ molecule selected as base for measuring the octane number and to which (as pure product) RON=100 and MON=100 have been assigned for definition.

The main problem of this process is linked to the difficulty in controlling the reaction temperature. Temperatures which are too high, in fact, cause the excessive production of heavy oligomers, such as trimers and tetramers of isobutene (F. Asinger, "Monoolefins: Chemistry and Technology", Pergamon Press, Oxford, pages 435–456 and G. Scharfe, Hydrocarbon Proc., April 1973, 171).

Tetramers cannot enter into gasoline as they are too high-boiling and therefore represent a net loss in yield to gasoline. In addition the presence of significant quantities of tetramers is also a symptom of the presence of higher oligomers, which are precursors of rubber and therefore undesirable as components for gasolines.

As far as trimers are concerned (or their hydrogenated derivatives), their concentration in gasoline must also be limited (below 10–20%), as their boiling point (170–180° C.) puts them at the limit of future specifications.

Owing to what is specified above, there is there-fore great interest in new dimerization processes of isobutene which allow the production of a higher quality product, by obtaining greater selectivities.

These problems have recently been overcome by means of a new simultaneous dimerization and etherification process (M. Marchionna, M. Di Girolamo, F. Ancillotti, IT-MI95/A001140). In this way, it is possible to obtain the coproduction of MTBE (ETBE) and a fraction of oligomers of iso-olefin, particularly rich in dimers (85–90%), with a very limited content of tetramers (thousands of ppm) and practically without higher oligomers.

The olefinic fraction, mostly consisting of dimers, is separated by distillation from the ether and can be injected as such into the gasoline, or it can be subsequently hydrogenated to give a completely saturated end-product with a high octane number, a low sensitivity and low vapour pressure. This product mainly consists of iso-octane (R. Trotta, M. Marchionna, Petr. Tech. Quat. Autumn 1997, 65).

A further extension of this process can even allow the synthesis of the hydrocarbon product alone without the net production of MTBE (or ETBE) (M. Di Girolamo, L. Tagliabue, IT-MI97A 001129).

Both processes enable the hydrocarbon product/ether ratio to be varied within very wide limits until the production of one of the two is entirely eliminated to the advantage of the other (R. Trotta, M. Marchionna, M. Di Girolamo, E. Pescarollo, Oil & Gas Eur. Mag., 3(1998), 32).

This process can be applied to $C_4$ olefinic streams, containing isobutene, with a different composition. The relative streams typically contain, inside the $C_4$ fraction, isobutane, isobutene, n-butane and n-butenes in different proportions; although a wide variety of sources is available for supplying these streams, the most common ones are those deriving from dehydrogenation processes of iso-paraffins, FCC units, streams coming from Steam Crackers or isobutene deriving from the dehydration of ter-butanol (or isobutanol).

The hydrocarbon product is of an even higher quality (greater octane number and lower volatility) than that of the alkylated products normally produced in the alkylation process (see table 1). In addition, by carrying out the dimerization/etherification process or dimerization process alone with typical catalysts (cationic exchange resins) for the synthesis of MTBE, none of the environmental impact problems typical of the alkylation process are observed.

In those countries (or refineries) where the legislative limit on the olefin content does not represent a problem, as an alternative to the totally hydrogenated stream rich in iso-octane, it is possible to directly use the olefinic stream extremely rich in diisobutenes (iso-octene): also this fraction has excellent blending octane numbers, very similar to those of MTBE.

Table 1 compares the characteristics of a mixture of non-hydrogenated or totally hydrogenated compounds, deriving from the selective oligomerization of isobutene in which the dimers of isobutene and possible co-dimers of isobutene with n-butane are in a quantity of 90% by weight, with those of a typical alkylated product from n-butenes and with MTBE.

It should be noted that the characteristics of these mixtures of non-hydrogenated or totally hydrogenated compounds vary slightly depending on the nature of the charge containing isobutene (R. Trotta, M. Marchionna, Petr. Tech. Quat., Autumn 1997, 65). It has been observed that when isobutene derives from the hydrogenation of isobutane, slightly higher octane umbers are obtained than those by treating the isobutene present in charges from FCC.

It can therefore be concluded that with these etherification and selective dimerization processes, desired products can be obtained, in any ratio, improving the characteristics of the hydrocarbon product with respect to the alkylated product obtained with the traditional method (the respective distillation curves are very similar, except for the lighter fraction), but without coming up against all the environmental and safety problems deriving from the handling of the acid catalyst.

Not surprisingly, a fact has recently emerged which could jeopardize a great deal of what has been described so far (at least as far as ter-alkyl ethers are concerned). In fact, the use of MTBE in gasoline has been strongly questioned in California, the most important market in the United States; MTBE has in fact been found in groundwater (also partly drinkable) and this has caused great protest.

As a result of this, Californian legislators are evaluating whether to ban the use of MTBE in gasolines and, if so, to evaluate the minimum period for enabling refiners to reformulate their gasoline, in compliance with the legislations in force.

It should be noted that in California a gasoline is used that can satisfy two different legislations: for state law, the whole state of California uses a gasoline called "Cleaner Burning Gasoline", whose composition is established by CARB (California Air Resources Board). CARB does not set any obligation for oxygen which is free within the range of 0–2.7%.

In California however, for federal law, four metropolitan areas must use federal gasoline "Reformulated Gasoline" (RFG) which imposes the minimum use of 1.8% of oxygen. These areas are Los Angeles, San Francisco, San Diego and Sacramento and represent about 70% of the total amount of gasoline consumed in California. In California therefore, all the gasoline is reformulated, but with two different formulations, 70% is Federal RFG with a compulsory 1.8% of oxygen, whereas 30% is CARB without any obligation of oxygen but whose composition is established by a predictive model which is even stricter than that regulating the Federal RFG. This makes a possible ban of MTBE even more complex. In fact, MTBE is necessary for Federal RFG owing to the compulsory minimum limit of oxygen but is also necessary for CARB gasoline for various reasons (J. Vautrain, Oil & Gas J., Jan. 18, 1999, 18):

MTBE has a diluting effect owing to the high concentrations in which it is used (11–15%), and therefore allows the concentration of undesired components to be reduced (such as aromatics, compounds containing sulfur, . . . ). If MTBE is removed without adding another diluent ad hoc, this beneficial effect would be lost.

MTBE provides a considerable octane supply which has enabled the content of benzene and aromatics to be reduced.

It should be noted that the Californian case may be just the starting point for a process which could be extended to the rest of the United States and possibly the whole world.

If the use of MTBE is banned, refiners will have, in theory, three main possibilities for formulating gasoline:

Using ethanol instead of MTBE.

Using different ter-alkyl ethers from MTBE or terbutanol.

Using a gasoline without oxygenated compounds.

It should be observed however that the second solution is not very likely as other ethers are only available in minimum quantities and the toxicological information available is very limited; it is therefore probable that these ethers may create the same problems as those relating to MTBE. The third solution is possible for all known commercial gasolines on a world-wide scale except for Federal RFG. In this latter case, the first solution could be the most interesting.

The use of ethanol could provide various advantages: its toxicology is known and does not create any suspicion; it is already present on the United States market and its octane properties are at least equal to those of MTBE. On the other hand its high vapour pressure is a problem and in addition, with an equal oxygen content, its octane supply is less than that of MTBE owing to a lower diluting effect.

Above all, in the summer months the high vapour pressure of ethanol is a great problem and if a refiner wished to use ethanol in the summer season he would have to resort to very particular formulations which would enable him to overcome the problems relating to the use of ethanol and the lack of MTBE. In fact, whereas a 10% of ethanol would give the same diluting effects and octane supply as MTBE, it would be very difficult to reach the volatility specification.

In conclusion, this solution also appears to be extremely problematical and, if MTBE were to be banned, refiners would be faced with the necessity of radically modifying the structure of their refinery.

It has now been surprisingly found that the use of high-octane hydrocarbon components deriving from the selective oligomerization of isobutene, has a synergic effect with that of some low-boiling and high-octane components, such as for example, ethanol, and enables all the problems described above to be overcome.

In addition, this specific use can also comprise the formulation of gasolines not containing oxygen but at the same time complying with the strictest environmental specifications.

The present invention relates to a liquid mixture suitable as gasoline characterized in that it has a RON octane number equal to or higher than 90 and a MON octane number equal to or higher than 80 and that it essentially consists of:

a typical gasoline cut, having a boiling point ranging from 30 to 220° C., consisting of hydrocarbon compounds;

one or more compounds deriving from the selective oligomerization of isobutene, which may optionally have been at least partially hydrogenated, in a quantity ranging from 0.5 to 20% by weight, preferably from 5 to 18%, wherein the dimers of isobutene and possible co-dimers of isobutene with n-butenes are in a quantity of at least 80% by weight, preferably at least 85%, more preferably at least 90%;

optionally ethanol in a quantity ranging from 0 to 10% by weight, preferably from 0.5 to 6%, the complement to 100 being said gasoline cut.

The isobutene for obtaining the oligomerized compounds can come from $C_4$ hydrocarbon refinery cuts or from steam-cracking petrochemical plants or field gas plants, which contain it, or from the dehydration of ter-butanol or iso-butanol, coming from the conversion of $CO/H_2$ in methanol and higher alcohols, mainly isobutanol. Mixtures containing isobutene coming from different sources can be advantageously treated.

The fraction of isobutene oligomers, characterized by a high octane number and a low volatility, is extremely rich in dimers (iso-octene) and can be added as such to the gasoline or it can be hydrogenated to give a mixture of saturated hydrocarbon compounds (extremely rich in iso-octane) of a very high quality (high octane number and low volatility).

There are numerous effects of the present invention, which are treated as follows:

Owing to the particular nature of the production process, this solution provides a more rapid reply to a possible MTBE ban as the raw material for producing MTBE is the same as that used to produce compounds deriving from the oligomerization of isobutene.

The joint use of ethanol and mixtures rich in iso-octane and/or iso-octene allows the minimum limits on the oxygen content to be satisfied but at the same time enables both the desired octane and volatility specifications to be reached (even in summer). In addition the diluting effect of the mixture is preserved.

The characteristics of this type of component overcome all the typical limitations of the alkylated product and therefore avoid all the drawbacks related to the production of a gasoline without oxygen; in fact, whereas it is known that refiners have occasionally set up small productions of this type of gasoline, it should be noted that, without solutions such as the one claimed herein, enormous investments are necessary for enabling the refiner to produce, on a wide scale, a gasoline which must be subjected to such strict specifications.

Owing to the low volatility of this type of component a significant fraction of butanes can be further mixed in the gasoline thus providing a further economic advantage.

Some examples are provided for a better illustration of the present invention but do not limit its scope in any way.

The evaluation of the volatility and octane number was experimentally effected in accordance with the method ASTM D-4814. In the following examples the experimental data obtained are specified directly.

EXAMPLE 1 (Comparative)

This example describes a typical behaviour of MTBE mixed with a gasoline having a relatively low octane number, (RON+MON)/2 of 87.0 and a very low volatility, 6.5 psi; this gasoline is hereinafter indicated as Base 1 Gasoline.

On adding 11% by weight of MTBE to this gasoline, i.e. 2% by weight of oxygen, the following results were obtained (all the percentages specified in the subsequent examples always refer to weight):

RVP=6.64

(RON+MON)/2, hereinafter always indicated as ON=89.3

EXAMPLE 2 (Comparative)

This example describes the effect of a greater addition of MTBE (up to the maximum oxygen limit) mixed with the Base 1 Gasoline previously used.

On adding 15% of MTBE to this gasoline, i.e. 2.7% oxygen, the following results were obtained:

RVP=6.85 psi; ON=90.2

It can be seen that with a gasoline having such a low volatility, the strictest volatility specifications (7 psi max in California for the summer months) are still respected, also with this addition of oxygen.

EXAMPLE 3 (Comparative)

This example describes the addition of ethanol to Base 1 Gasoline with the same percentages of oxygen as Example 1.

On adding 5.8% of EtOH, i.e. 2.0% oxygen, the following results were obtained:

RVP=7.34 psi; ON=88.3

It can be seen that, also with a gasoline having such a low volatility, the strictest volatility specifications (7 psi max in California for the summer months) are not respected; in addition with respect to MTBE in an equal concentration of oxygen, the diluting effect is lower (5.8% by volume vs 11%) and the same octane numbers are not reached (about 1 point less).

EXAMPLE 4

This example describes the addition to Base 1 Gasoline of a mixture containing ethanol and iso-octane.

On adding 5.8% of EtOH, i.e. 2.0% of oxygen, and 10% of a mixture of totally hydrogenated compounds deriving from the selective oligomerization of isobutene in which the dimers of isobutene and possible co-dimers of isobutene with n-butane are in a quantity of 88% by weight, the following results were obtained:

RVP=6.86 psi; ON=89.6

In this way the addition of this mixture of totally hydrogenated compounds satisfies the strictest requirements relating to the volatility specification and also those relating to the octane increase, maintaining a minimum content of oxygen. In addition it provides a diluting effect which is comparable with that obtained using 15% of MTBE.

EXAMPLE 5

This example describes the addition to Base 1 Gasoline of a mixture containing ethanol (5.2%), with the minimum percentage of oxygen specified by law (1.8% by weight), and 10% of a mixture of totally hydrogenated compounds deriving from the selective oligomerization of isobutene in which the dimers of isobutene and possible co-dimers of isobutene with n-butane are in a quantity of 88% by weight. With this mixture the following results were obtained:

RVP=6.77 psi; ON=89.5

In this way both the strictest requirements relating to volatility and the octane increase are satisfied (providing a considerable diluting effect, equal to 15% of MTBE).

EXAMPLE 6 (Comparative)

This example compares the effect of the addition to Base 1 Gasoline of 10% of a typical alkylated product (obtained from isobutane and n-butenes) and ethanol (1.8% by weight), with what is described in example 5 which comprises the addition of 10% of totally hydrogenated compounds instead of the alkylated product.

The following results were obtained with this mixture:

RVP=7.14 psi; ON=89.1

In this way the strictest requirements relating to volatility are not satisfied and the octane increase is lower than the previous example.

To obtain the same volatility as the previous example it would be necessary to use about 23% of alkylated product (against 10% of iso-octane) obtaining an octane number of 90.1, higher than in the previous case but obtained by decisively modifying the composition of the gasoline.

This example therefore demonstrates how the addition of these completely hydrogenated compounds (or not hydrogenated when possible) is much more effective than that of a typical alkylated product; it can also be observed that the effect would be even greater if the alkylated product were not produced from n-butenes alone but also from $C_3$–$C_5$ olefins.

EXAMPLE 7

This example describes the percentage of mixture of totally hydrogenated compounds, deriving from the selective oligomerization of isobutene in which the dimers of isobutene and possible co-dimers of isobutene with n-butane are in a quantity of 88% by weight, to be added to Base 1 Gasoline, necessary for obtaining the same octane number obtained with the addition of MTBE at 2% of oxygen (see Example 1).

Using 17.8% of this mixture of totally hydrogenated compounds an ON of 89.3 and a very low volatility of 5.65 psi are obtained; it is evident that the effect of this mixture can be even more effective (and smaller quantities of this mixture could be used) if a base-gasoline with a higher volatility and greater octane number is used.

Significant quantities of n-butane can be added to a gasoline with such a low volatility, providing an increase in both the yield to gasoline and in the octane number and with a consequently beneficial economic impact.

If there are no particular (or too severe) specifications as to the content of olefins, the mixture of compounds, without being hydrogenated, deriving from the selective oligomerization of isobutene in which the dimers of isobutene and possible co-dimers of isobutene with n-butane are in a quantity of 88% by weight, can also be more advantageously used.

In this case the octane number of 89.3 is reached by adding 14.4% of this mixture of non-hydrogenated compounds; the volatility of the corresponding gasoline is 5.78 psi.

EXAMPLES 8–16

Table 2 indicates the results obtained by adding the components analogously to what is described in the previous Examples, using a gasoline with an equal octane number with respect to Base 1 Gasoline but with and increased volatility (8.0 psi); this gasoline is called Base 2 Gasoline.

On the basis of this data the following additional observations can be made with respect to what has already been described in the previous examples: with a more volatile gasoline it is much more difficult to reach the strictest volatility specifications using oxygenated components. When there is no compulsory minimum limit on the oxygen content, it is very interesting to use mixtures of compounds of a mixture of hydrogenated or non-hydrogenated compounds deriving from the selective oligomerization of isobutene which reach even the most severe volatility limits, maintaining the octane level and diluting effect obtained with MTBE.

EXAMPLES 17–26

Table 3 indicates the results obtained by adding the components analogously to what is described above, using a gasoline with the same volatility (8.0 psi) but with an increased octane number, ON=90.0 with respect to Base 2 Gasoline.

This gasoline is called Base 3 Gasoline.

On the basis of these data, similar observations can be made to those relating to all the previous examples: in addition, it can be observed that with a more volatile gasoline and with a higher octane number the role of the purely hydrocarbon components is even more accentuated.

TABLE 1

Properties of a mixture of non-hydrogenated (Mixt. rich in iC8 olef.) or totally hydrogenated (Mixt. rich in iC8 par.) compounds, deriving from the selective oligomerization of isobutene in which the dimers of isobutene and (possible) co-dimers of isobuten with n-butane, are in a quantity of 90% by weight with respect to the alkylated product and MTBE.

| Source Feed | Mixt. rich in iC8 olef. De-hydrog. | Mixt. rich in iC8 olef. FCC | Mixt. rich in iC8 olef. De-hydrog. | Mixt. rich in iC8 olef. FCC | Normal alkylate | MTBE |
|---|---|---|---|---|---|---|
| Clear RON | 100.2 | 99.4 | — | — | 96.0 | — |
| Clear MON | 100.3 | 98.3 | — | — | 94.0 | — |
| Blending RON* | 101–103 | 100–102 | 114–118 | 112–115 | 97–99 | 115–118 |
| Blending MON* | 96–98 | 94–97 | 95–97 | 93–96 | 90–92 | 98–102 |
| RVP (psi) | 1.7 | 1.7 | 1.5 | 1.6 | 4.5 | 8.0 |
| Spec. gravity | 0.720 | 0.720 | 0.733 | 0.728 | 0.697 | 0.745 |

TABLE 2

| Example | Mixture composition | Rvp (psi) | ON |
|---|---|---|---|
| 8 (comp.) | 11% MTBE | 8.09 | 89.3 |
| 9 (comp.) | 15% MTBE | 8.12 | 90.2 |
| 10 | 5.8% Ethanol | 8.76 | 88.3 |
| 11 | 5.2% Ethanol + 10% Mixture rich in par. iC8 | 8.13 | 89.5 |
| 12 | 10% Mixture rich in par. iC8 | 7.37 | 88.3 |
| 13 | 17.8% Mixture rich in par. iC8 | 6.88 | 89.3 |
| 14 | 15% Mixture rich in olef. iC8 | 7.02 | 90.0 |
| 15 | 5.2% Ethanol + 10% Mixture rich in olef. iC8 | 8.03 | 90.1 |
| 16 | 5% Mixture rich in olef. iC8 + 10% Mixture rich in par. iC8 | 7.05 | 89.3 |

TABLE 3

| Example | Mixture composition | Rvp (psi) | ON |
|---|---|---|---|
| 17 (comp.) | 11% MTBE | 8.09 | 92.0 |
| 18 (comp.) | 15% MTBE | 8.12 | 92.7 |
| 19 | 5.8% Ethanol | 8.76 | 91.2 |
| 20 | 5.2% Ethanol + 10% Mixture rich in par. iC8 | 8.13 | 92.0 |
| 21 | 10% Mixture rich in par. iC8 | 7.37 | 91.0 |
| 22 | 16% Mixture rich in par. iC8 | 6.99 | 91.6 |

TABLE 3-continued

| Example | Mixture composition | Rvp (psi) | ON |
|---|---|---|---|
| 23 | 15% Mixture rich in olef. iC8 | 7.02 | 92.4 |
| 24 | 5.2% Ethanol + 10% Mixture rich in olef. iC8 | 8.03 | 92.6 |
| 25 | 5% Mixture rich in olef. iCB + 10% Mixture rich in par. iC8 | 7.05 | 91.8 |
| 26 | 5.2% Ethanol + 5% Mixture rich in olef. iC8 + 5% Mixture rich in par. iC8 | 8.04 | 92.3 |

What is claimed is:

1. A liquid mixture suitable as gasoline characterized in that it has a RON octane number equal to or higher than 90 and a MON octane number equal to or higher than 80 and that it consists essentially of:

(A) a typical gasoline cut, having a boiling point ranging from 30 to 220° C., consisting of hydrocarbon compounds;

(B) one or more compounds derived from the selective oligomerization of isobutene, which may optionally have been at least partially hydrogenated, in a quantity ranging from 0.5 to 20% by weight, wherein dimers of isobutene and possible co-dimers of isobutene with n-butenes are in a quantity of at least 80% by weight; and (C) ethanol in a quantity up to 10% by weight, wherein said quantity for component (B) and said quantity for component (C) are subject to a proviso that components (B) and (C) are present in synergistic effective amounts.

2. The liquid mixture suitable as gasoline according to claim 1 wherein the compound or compounds derived from the selective oligomerization of isobutene are present in a quantity ranging from 5 to 18% by weight.

3. The liquid mixture suitable as gasoline according to claim 1 or 2 wherein the dimers of isobutene and possible co-dimers of isobutene with n-butane are in a quantity of at least 85% by weight.

4. The liquid mixture suitable as gasoline according to claim 3, wherein the dimers of isobutene and possible co-dimers of isobutene with n-butane are in a quantity of at least 90% by weight.

5. The liquid mixture suitable as gasoline according to claim 1 wherein the ethanol is in a quantity ranging from 0.5 to 6% by weight.

* * * * *